United States Patent [19]

Knauer

[11] Patent Number: 4,730,794

[45] Date of Patent: Mar. 15, 1988

[54] METHOD AND APPARATUS FOR ANGLE CODING

[75] Inventor: Wolfgang Knauer, Kienberg, Fed. Rep. of Germany

[73] Assignee: Messerschmitt-Bölkow-Blohm GmbH, Munich, Fed. Rep. of Germany

[21] Appl. No.: 47,664

[22] Filed: May 8, 1987

[30] Foreign Application Priority Data

Jul. 29, 1986 [DE] Fed. Rep. of Germany ..... 3625649

[51] Int. Cl.[4] ..... F41G 7/00

[52] U.S. Cl. ..... 244/3.14; 89/1.1; 89/1.11; 89/6.5

[58] Field of Search ..... 89/6.5, 1.1, 1.819, 89/1.816, 14.05, 1.11, 41.19; 244/3.14, 3.11

[56] References Cited

U.S. PATENT DOCUMENTS

| | | | |
|---|---|---|---|
| 2,980,363 | 4/1961 | Schonstedt | 244/3.14 X |
| 2,995,749 | 8/1961 | Robinson | 244/3.14 X |
| 3,141,635 | 7/1964 | Davis et al. | 244/3.14 |
| 3,374,967 | 3/1968 | Plumley | 244/3.14 |
| 3,860,199 | 1/1975 | Dunne | 244/3.13 |
| 3,990,659 | 11/1976 | Moore et al. | 244/3.14 X |
| 3,995,792 | 12/1976 | Otto et al. | 244/3.14 |
| 4,111,385 | 9/1978 | Allen | 244/3.13 |
| 4,219,170 | 8/1980 | Esker | 244/3.14 |
| 4,641,801 | 2/1987 | Lynch et al. | 244/3.14 |

*Primary Examiner*—David H. Brown

*Attorney, Agent, or Firm*—Kenyon & Kenyon

[57] ABSTRACT

A method and a device for angle coding a guided smooth-tube projectile, by which the roll position existing at the launching can be coded irreversibly for any insertion position of the projectile in the launching tube.

2 Claims, 2 Drawing Figures

METHOD AND APPARATUS FOR ANGLE CODING

BACKGROUND OF THE INVENTION

The present invention relates to a method and apparatus for angle coding in a projectile which can be guided by means of a data transmission device, can be launched from a smooth-walled tube and begins to rotate immediately after leaving the launching tube.

Such trackable projectiles which begin to rotate only after leaving the launching tube, require exact information as to their instantaneous roll position for carrying out guidance maneuvers. For guiding the projectiles, for instance, guide beams with polarized light are used which allow detection of the roll position. This method, however, has the disadvantage that in the position information obtainable from the light beams, an ambiguity is always still present as to whether the projectile is, relatively in the 0° or the 180° position. For this reason, a fixed precoding of the roll position in the projectile is necessary. This, however, requires a large amount of technical means for the signal processing in the projectile if additional information regarding the roll position must further be processed. Practically, this could be accomplished by evaluating guide beam information by a stern receiver of the projectile, but this is hardly possible due to the heavy smoke development at the start. Otherwise, it is necessary to insert the projectile into the launching tube with a given roll orientation prior to the launching. This is not feasible in practice, however. The above mentioned disadvantages are to be avoided by means of the present invention.

SUMMARY OF THE INVENTION

It is therefore an object of the present invention to code in trackable smooth-tube projectiles the roll position present at the launching in such a manner that this can be accomplished on the one hand for any insertion position of the projectile in the launching tube and that, on the other hand, the thus achieved roll position coding is preserved during the flight.

The above and other objects of the present invention are achieved in a method for angle coding in a projectile by the provision that the launching tube comprises a coding device for attaching a marking serving as a position reference for guiding the projectile, and that the projectile contains a device which is arranged at the circumference of the projectile jacket, corresponds to the location of the coding device of the launching tube and can be coded by the coding device irreversibly.

The apparatus for carrying out the method for angle-coding a guided projectile according to the invention is characterized by the features that the launching tube has at a given location with known position relative to the tube axis, a firing pin with a radial direction of action aimed at the tube axis, and that the projectile comprises a codable device which circles the projectile jacket at the circumference and corresponds, in the launching position of the projectile, effectively to the firing pin. The codable device comprises a multiplicity of bolts which are aligned radially to the roll axis and which are surrounded by a ring-shaped deformable subarea of the projectile jacket. The bolts surround, in insulated fashion, a ring-shaped conductor run and a ring-shaped resistance path arranged concentrically with a small spacing from each other and both with a spacing from the bolts. When the firing pin fires, it forces one of the bolts into conductive engagement with the conductor run and the resistance path, thus generating a resistance signal which identifies the angle of the projectile, in the manner of a potentiometer.

BRIEF DESCRIPTION OF THE DRAWINGS

The invention will be described in greater detail in the following detailed description, with reference to the drawings, in which.

DETAILED DESCRIPTION

Figure 1:
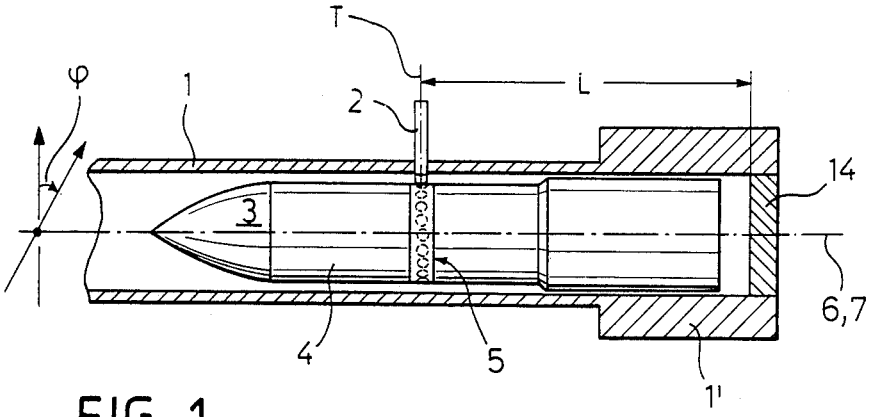
FIG. 1 shows a schematically simplified section through a launching tube with a projectile.

With reference now to the drawings, FIG. 1 shows, in simplified form, a smooth-walled launching tube 1 which contains a closure 14 which is reinforced in the region of its end 1'. In the launching tube 1 is shown a steerable projectile 3.

The launching tube 1 has at a location, the position of which is accurately fixed, a device 2 for the purpose of transmitting the position T to an irreversibly codable device 5 in the projectile 3. The position of the coding device 2 is fixed relative to the launching tube on the one hand by the dimension L which is given by the location of the device 5 to be coded in the projectile 3 inserted ready for starting. On the other hand, the angular dimension $\phi$ relative to the tube axis 6 is arbitrarily chosen as the reference dimension. In the embodiment, $\phi=0°=T$ was fixed for this purpose. The reference systems are defined here in such a manner that the roll axis 7 of the projectile 3 coincides with the tube axis 6 of the launching tube 1.

Figure 2:
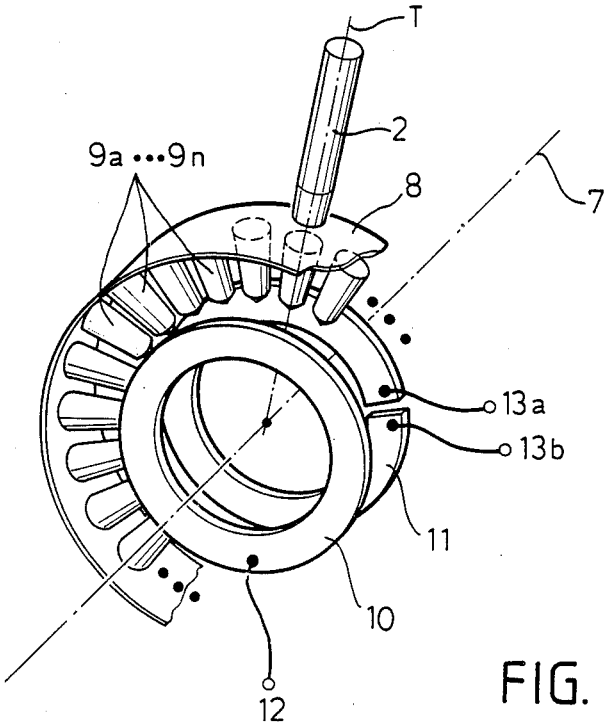
FIG. 2 shows a section through a roll angle coding device according to the invention.

In FIG. 2, a functional embodiment of a decoding device according to the invention is shown in a simplified manner. The coding device comprises a spring-loaded firing pin 2 positioned in the launching tube 1 in accordance with the description of FIG. 1. With the projectile inserted ready to start, the device 5 to be coded corresponds therewith as far as its position is concerned. This device 5 has, first, an easily deformable covering 8 which forms a circular subarea of the projectile jacket 4. This part can be made as a plastic or soft metal ring. Within the subarea 8, a multiplicity of short pins *9a*, . . . *9n* of conductive material is arranged, all of which are aligned radially to the roll axis 7 of the projectile 3. The number of pins depends on the desired angular resolution of the coding device. The quantizing of the angle is obtained as $\phi=360°/n$, n representing the number of pins. Concentrically within the pins *9a*, . . . *9n*, two concentric annular tracks, a conductor track 10 and a resistance track 11, are arranged. The latter are arranged insulated from each other as well as from the pins *9a*, . . . *9n*. The tracks have contacts 12 and *13a*, *13b*. The tracks 10 and 11 are arranged relative to the pins in such a manner that upon actuation of the firing pin 2, at least one pin 9 is hit and in the process is shifted toward the roll axis 7 in such a manner that an electrically conducting connection between the conductor run 10 and the resistance path 11 is provided. Thereby, a tap of a resistance value defined by the position of the hit pin 9 relative to the resistance path 11 is obtained between the contacts 12 on the one hand and *13a*, *13b* on the other hand, in the manner of a potentiometer. This once-fixed resistance value remains irreversibly preserved due to the fixation of the hit pin with respect to tracks 10,11. During the flight of the projectile it serves as an unequivocal position reference of the roll position for the control of the projectile. The resistance value characterizes the roll position at the launching. Since, due to the setting of its control wings, the projectile begins to rotate only slowly and in accordance with a reproducible time relationship, it is sufficient for steering maneuvers during flight that make sense, to know the roll position at the launching and to then calculate it via the time relationship stored in the control device until the guiding beam is received and thereby, counting of the roll revolutions becomes possible.

The special advantage of the invention is seen in the fact that an unequivocal irreversible roll-position coding in a tracking smooth-tube projectile is obtainable which is independent of the insertion position of the projectile in the smooth-walled launching tube.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A method for angle coding in a projectile, adapted to be guided by a data transmission device, the projectile adapted to be launched from a smooth walled tube and beginning to rotate immediately after leaving the launching tube, the method comprising the steps of providing the launching tube with a coding device for attaching a marking to the projectile serving for guiding the projectile as a position reference, disposing a codable device on the projectile arranged at the circumference of the projectile jacket, which corresponds to the location of the coding device of the launching tube, and irreversibly coding said codable device with said coding device.

2. Apparatus for angle coding in a projectile adapted to be guided by a data transmission device, the projectile adapted to be launched from a smooth walled tube and beginning to rotate immediately after leaving the launching tube, comprising a coding device disposed on the launching tube for attaching a marking to the projectile serving for guiding the projectile as a position reference, a codable device disposed on the projectile arranged at the circumference of the projectile jacket at a position corresponding to the location of the coding device of the launching tube, said codable device being irreversibly coded by said coding device, said coding device comprising a firing pin disposed on the launching tube at a defined location with known position relative to the tube axis and having a radial direction of action aimed at the tube axis, said codable device being disposed circularly at the circumference of the projectile jacket and corresponding to the location of the firing pin in the launching position of the projectile, said codable device further comprising a plurality of bolt means of conductive material which are radially aligned to the roll axis of the projectile and are surrounded by a ring-shaped deformable subarea of the projectile jacket, said bolt means surrounding a ring-shaped conductor run provided concentrically within the bolt means and arranged insulated therefrom, said bolt means being arranged with a small spacing relative to the conductor run, a ring-shaped ohmic resistance path being further arranged at a small spacing from the conductor run and said bolt means, said resistance path being insulated from said conductor run and said bolt means and being arranged concentrically with said conductor run.

* * * * *